United States Patent [19]

Enste et al.

[11] 4,441,221

[45] Apr. 10, 1984

[54] CHILD SUPPORT WEDGE

[75] Inventors: Klemens Enste, Hitchinstrasse 36, 6530 Bingen, Fed. Rep. of Germany; Sigrun Giessmann, Rockenhausen, Fed. Rep. of Germany

[73] Assignee: Klemens Enste, Bingen, Fed. Rep. of Germany

[21] Appl. No.: 388,645

[22] Filed: Jun. 15, 1982

[30] Foreign Application Priority Data

Jun. 15, 1981 [DE] Fed. Rep. of Germany ..... 3123632

[51] Int. Cl.[3] ..... A61G 7/02

[52] U.S. Cl. ..... 5/431; 5/443; 5/465; 297/464; 297/118

[58] Field of Search ..... 272/144; 5/431, 432, 5/437, 443, 465; 297/464, 467, 1, 3, 118

[56] References Cited

U.S. PATENT DOCUMENTS

| | | | |
|---|---|---|---|
| 433,905 | 8/1890 | Muller | 5/465 |
| 885,243 | 4/1908 | Haas | 272/144 |
| 3,137,012 | 6/1964 | Halterman | 5/432 |
| 3,273,174 | 9/1966 | Cassini | 5/432 |
| 3,333,286 | 8/1967 | Biolik | 5/431 |
| 3,423,773 | 1/1969 | Yamate | 5/443 |
| 3,736,023 | 5/1973 | Lyons | 297/118 |
| 3,742,528 | 7/1973 | Munch | 5/465 |
| 3,992,057 | 11/1976 | Studebaker | 297/467 |
| 4,327,714 | 5/1982 | Spann | 5/443 |
| 4,382,306 | 5/1983 | Lickert | 5/449 |

*Primary Examiner*—Richard J. Johnson

*Attorney, Agent, or Firm*—Collard, Roe & Galgano

[57] ABSTRACT

A gymnastic and support wedge for babies and toddlers, especially for multiple and severely handicapped children at kingergarten and school age, includes a wedge-like base plate member, a pair of lateral trough wedge members mountable on the base plate member and a plurality of differently shaped individual members mountable between the trough wedge members in any desired position. All structural parts are detachably connected with each other.

16 Claims, 12 Drawing Figures

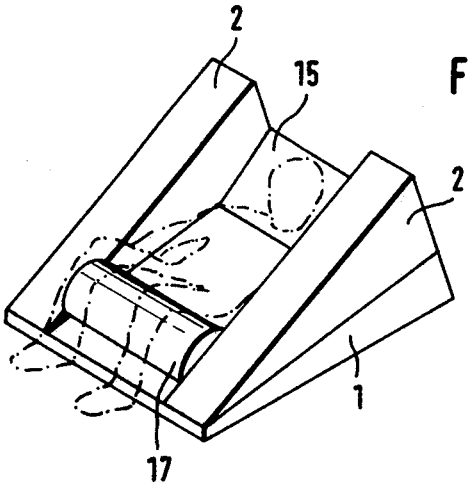
FIG. 2
FIG. 3
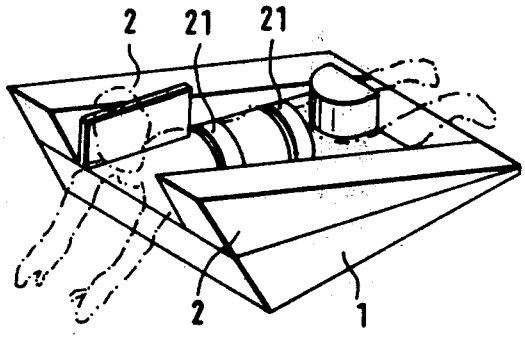
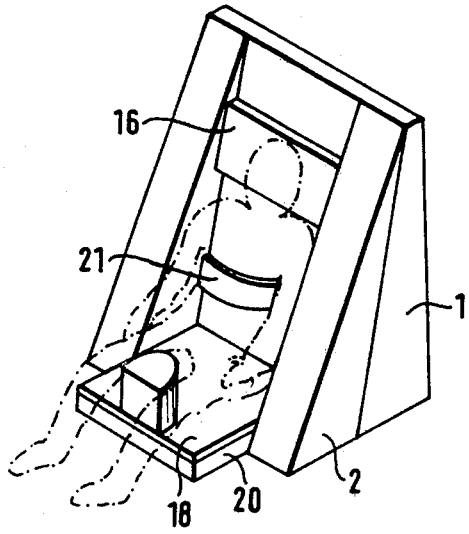
FIG. 4

CHILD SUPPORT WEDGE

The invention relates to a gymnastic and support wedge for babies and toddlers and in particular, for multiple and severely handicapped children of kindergarten and school age.

A gymnastic and support wedge is already known which merely consists of a wedge-like, upholstered base plate, which only permits a back or stomach position of the person to be placed thereon. However, with spastic paralyzed children, it is very often required to keep their limbs and, in particular, also their body, in a relaxed and thereby comfortable position for a defined time, so as to teach the child which position the body parts and, in particular, the body itself, should assume, so as to substantially eliminate the accompanying manifestations of spastic paralyzation, such as as muscle spasms, and the like.

It is an object the invention to provide a gymnastic and support wedge of the aforementioned type which, depending on the health situation of the child and, thereby, depending on the planned rehabilitation measures can be adjusted with a few manual manipulations for permitting different sitting and lying positions by the child so as to teach desired body postures.

This object of the invention is obtained in accordance with the invention in that a wedge-like base plate is provided with lateral trough wedges mounted thereon and differently shaped individual elements mounted between said trough wedges in any desired position, wherein all of the structural parts are detachably connected with each other. Advantageously, each structural part consists of a foamed material sheathed in artificial leather.

In a further embodiment of the invention, the individual elements comprise a head wedge, two flat pillows for reducing the trough between the trough wedges, a semicylindrical roll, a flat pillow with an integrated abduction wedge, as well as an associated lower pillow and two fixation belts.

In a further embodiment of the invention, the angle between the bottom face and rear face of the base plate, as well as the angle between the bottom face and the rear face of each trough wedge is always about 100°. Further, the base plate is advantageously rectangularly shaped and is provided with two longitudinally-extending artificial leather flaps at its upper side which are disposed along and spaced from the longitudinal sides of the base plate at a distance equal to the width of a trough wedge. Preferably, the width of the heat wedge, the flat pillow with the abduction part, the lower pillow and the semicylindrical roll correspond to the width of the trough between the upwardly-positioned artificial leather flaps and the associated trough wedges. The flat pillow with the abduction part and the lower pillow are preferably square shaped.

In order to obtain a problem free mounting of the structural parts of the gymnastic and support wedge between each other, the structural parts are fixed in their position between each other by a corresponding arrangement of stick on and padded belts in accordance with a further embodiment of the invention. The arrangement is such that the person using the gymnastic and support wedge comes into engagement with only the partially exposed padded belt.

The gymnastic and support wedge in accordance with the invention is extremely variable in its structure, whereby practically any suitable position for each child can be individually adjusted. The activation of the child with this gymnastic and support wedge and the substantially independent function possibilities this constantly correcting aid makes it possible for the supervising persons to simultaneously address a plurality of children and to activate them. Furthermore, a child can better sit or be in a resting position along with the other children and thereby partake in the group activities with the aid of the gymnastic and support wedge. In addition, the child is able to pursue the pleasing feeding activity in any assumed position. Since the gymnastic and support wedge is made from foamed plastic, it is light and can therefore be easily transported. The sheath for the individual parts of the gymnastic and support wedge which consists of artificial material is wear resistant easy to disinfect and multicolored.

In the drawings, wherein similar reference characters denote similar elements throughout the several views:

FIG. 2 is a perspective view of the gymnastic and support wedge assembled to accommodate the back rest position of a child;

FIG. 3 is a perspective view of the gymnastic and support wedge assembled to accommodate the stomach rest position of a child; and FIG. 4 is a perspective view of the gymnastic and support wedge assembled to accommodate the sitting position of a child.

Figure 1:
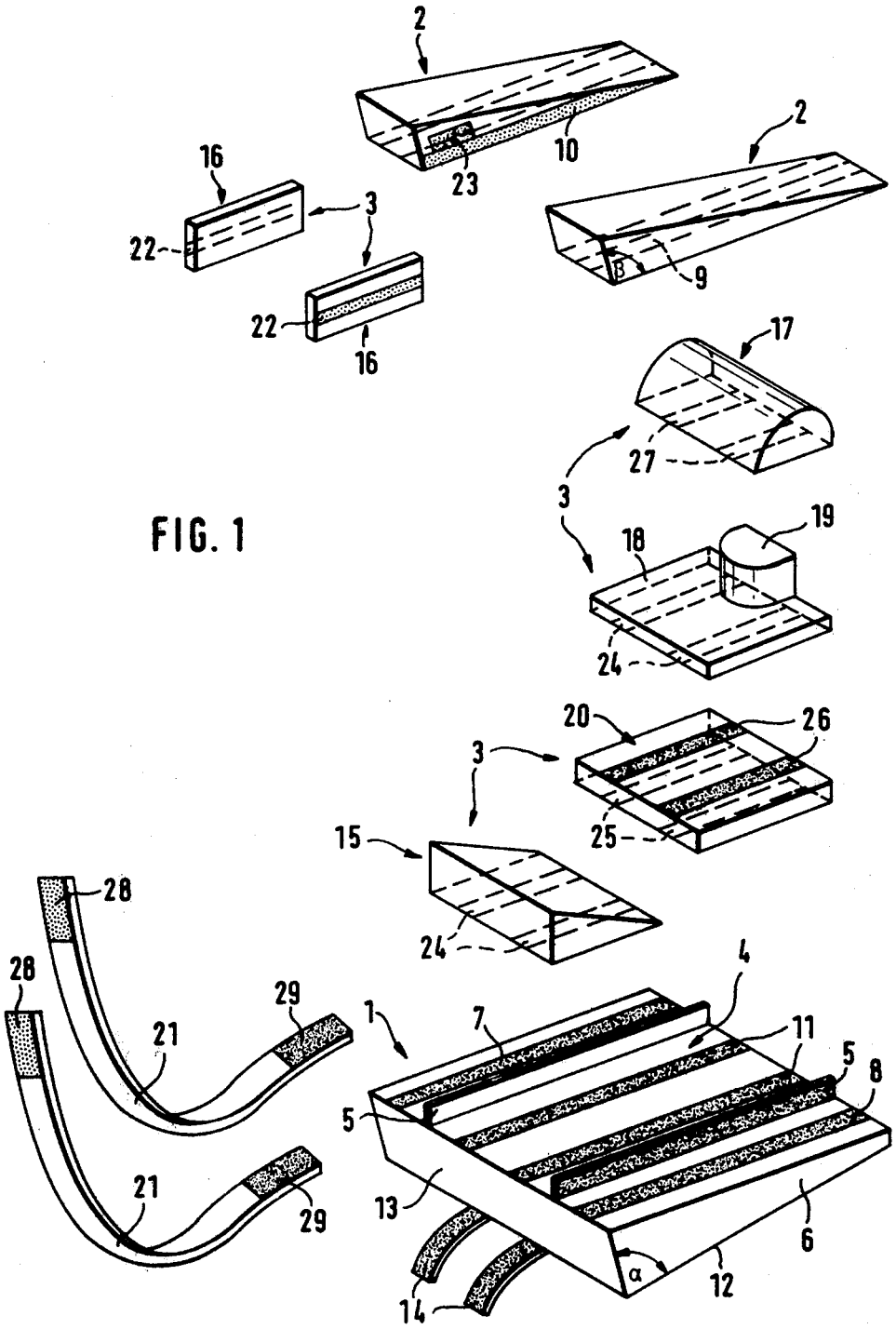
FIG. 1 is an exploded perspective view of the gymnastic and support wedge embodying the present invention.

Referring now in detail to the drawings, the gymnastic and support wedge consists of a base element in the form of a wedge like base plate 1 which has a rectangular shape and on which lateral trough wedges 2 are mounted. In the trough between the trough wedges 2, differently shaped individual elements 3 may be mounted in any desired position. All structural parts 1–3 of the gymnastic and support wedge are fixed in their position by a corresponding arrangement of stick-on and padded belts, whose exact mounting on the individual structural elements 1–3 is described in detail, hereinbelow and whose arrangement is such that the person using the gymnastic and support wedge comes into engagement with only partially exposed padded belts. The use of stick on and padded belts permits one to convert the gymnastic and support wedge with a few manual manipulations in a desired manner while simultaneously obtaining a sufficient mounting of the structural parts 1–3. The individual parts 1–3 consist of foamed plastic sheathed in artificial leather, which is provided in different colors for each structural part.

The base plate 1 is provided on its upper side with longitudinally extending artificial leather flaps 5 which are spaced from the longitudinal sides 6 of base plate 1 at a distance corresponding to the width of the trough wedges 2. At the side facing the associated trough wedge 2, each of the artificial flaps 5 is provided with a padded belt. Furthermore, on the upper side 4 of the base plate 1 along each of the longitudinal outer edges, a padded belt 78 is mounted. Stick on belts 9, 10 are mounted on the bottom face, as well as on the sidewall of each trough wedge 2 at the side thereof facing the artificial leather flap 5', corresponding to the padded belts 7, 8 of the base plate 1 and the padded belts on flaps 5, respectively. Furthermore, two padded belts 11 are arranged in a defined position to each other on the upper side 4 of the base plate 1 between the artificial leather flaps 5 and extending parallel thereto. Furthermore, two loose padded belts 14 are mounted on the bottom face 12 of the base plate 1 in the center portion of the back face 13. The padded belts 11, 14 serve to mount the individual elements 3 on the base plate 1 which are provided with the corresponding stick-on belts. For enlarging the trough of the gymnastic and support wedge the angle a between the bottom face 12 and the back face 13 of the base plate 1, as well as the angle $\beta$ between the bottom face and the rear face of each trough wedge 2 is about 100°.

The individual elements 3 of the gymnastic and support wedge comprise a head wedge 15, two flat pillows 16 for reducing the trough between the trough wedges 2, a semi-roll or semicylindrical element 17, a flat pillow 18 with integrated abduction part 19, as well as associated lower pillows 20 and two fixation belts 21. The width of the heat wedge 15, the flat pillow 18 with the abduction wedge 19, the lower pillow 20 and the semi-roll 17 corresponds to the width of the trough between the upwardly positioned artificial leather flaps 5 with the associated trough wedges 2. The two flat pillows 16 are each provided at one longitudinal side with one continuous stick-on belt 22 which corresponds with a padded belt 23 which is mounted above the stick-on belt 10 on the sidewall of each trough wedge 2 in the area of the wider end of the trough wedge 2. However, the flat pillows 16 may be mounted on the padded belts 11 of base plate 1, if need be, since their length corresponds to the width between the distance of trough wedges 2 on base plate 1.

The flat pillow 18 with the integrated abduction wedge 19 is provided on its lower side with two stick-on belts 24, which are spaced apart at a distance equal to the distance between the center padded belts 11 of base plate 1 and between which the abduction wedge 19 is mounted on the upper side of flat pillow 18.

The lower pillow 20 which can be used in conjunction with the flat pillow 18, if need be, has on its under side two stick-on belts 25 and on its upper side two padded belts 26 which are spaced apart in a manner corresponding to the distance between the two center padded belts 11 of the base plate 1.

The head wedge 15, as well as the semicylindrical roll 17 are provided on their lower side with two stick-on belts 24 or 27, respectively, spaced apart at a distance corresponding to the distance between the two center padded belts 11 of base plate 1. At their turning points, the fixation belts for retaining the gymnastic and support wedge being used by the person are alternately provided with a stick-on belt 28 and a padded belt 29, whereby the fixation belts are displaceable in any given position and are mounted between the trough wedges 2.

The gymnastic and support wedge permits a multifaceted and independent handling of a child, and in particular, a severely handicapped child in the following base positions:

1. Back Position

For assuming the back rest position of the child, the gymnastic and support wedge consists of the base plate 1, the trough wedges 2 mounted thereon, the head wedge 15 which is arranged on the wider end portion of the base plate 1 the trough wedges 2, the semi-cylindrical roll 17 which is positioned between the trough wedges 2 adjacent to the thinner end portion of the base plate 1 (see FIG. 2). The back rest position of the child serves as a safe base position without the need for any outside aid. This position is advantageously used during mouth and feeding therapy, during speaking initiation, coordination exercises, for eye exercises mouth and hand coordination and for two handed operations along the center line of the body. Due to the positioning of the head wedge 15, a relaxing of the opisthonic posture, as well as an initiation of the raising of the head from the back rest position can be made possible.

2. Stomach Position

For the stomach position of the child, the gymnastic and support wedge comprises the base plate 1, the trough wedges 2 mounted thereon, the flat pillow 18 with the integrated abduction wedge 19 positioned at the decreasing thinner end portion of base plate 1 between the trough wedges 2, the flat pillow 16 positioned at the wider increasing end portion between the trough wedges 2 and the fixation belt 21 wound around the body of the child. The stomach position effects a head control by relaxing the retraction of the arms and an initiation of the hand support, as well as the elbow support. With children who keep their arms tightly together, one has the possibility to obtain an abduction of the arms by a corresponding positioning of the flat pillow 18 with integrated abduction wedge 19, in that the child is supported with the elbows on its flat pillow 18. With limp children, the abduction part 19 can have a stimulating effect on the head. The stomach position is a favorable initial position for multiple and severely handicapped children. In this position, they can play relatively independently or with a minimum of assistance, they can perform touch and sensibility exercises of the hands, as well as contact other children. Furthermore, it is possible to obtain an abduction of the legs with children who are severely spastic by obtaining a relatively large bending of the hips in that the semi-cylindrical roll 17 is positioned below the hip and if the head wedge 15 is used to lift the upper chest area.

3. Side Position

For the side position at both sides of the child, the gymnastic and support wedge consists of the base plate 1 and the trough wedges 2 mounted thereon, whereby the two flat pillows 16 may be used, if need be. In the side position, the head of the child is positioned and held along the center line, and by simply turning one's eyes the child is able to see the toys. In this position, a relaxation of the pathological reflexology can be relatively easily obtained and the children have a chance to play with both hands. Often, the arms and legs move by themselves, particularly in the side position. In addition, the child has a better chance to observe its surroundings. In order not to block the vision, the trough wedge in front of the child can be lowered or, if need be, can be turned, so that the flat part of the wedge trough is disposed on the upper side.

4. Longitudinal Seating Position

The longitudinal seating position for the child is obtained with the aid of the gymnastic and support wedge by erecting the base plate 1 with the laterally mounted trough wedges 2, wherein the wider trough end portion is mounted on the floor (see FIG. 4). Advantageously, the gymnastic and support wedge is propped against a wall. Depending on the abduction capability of the hips, the flat pillow 18 with the abduction part 19 and/or the associated lower pillow 20 must be positioned below the buttocks of the child. These individual elements 18 or 20 are mounted on the padded belts 14 of the base plate 1 with their stick-on belts 24 or 25. A flat pillow 16 is positioned at the height of the child's head on the upper side of the base plate 1. The child can be retained in this position by means of the fixation belts 21. In the vertical position, the child can learn to manipulate with both hands and in the center line, it gets more stability at the head and body, can assume a contact with other children and can also learn or practice communication with other children. The vertical positioning of severely handicapped children is very important and meaningful with respect to the development of their perception and for enhancing their perception abilities.

5. Cross-Legged Seating Position

In the cross-legged sitting position, wherein the same structure exists in the gymnastic and support wedge as in the lying rest position, the relaxation of the abduction and the inner rotation of the legs can be predominantly enhanced. If a positioning is not sufficient, one can stress the upper thighs in a light outer rotation by correspondingly heavy rice bags. The enhancement possibilities stated under point 4 can all be performed in the cross-legged sitting position.

Naturally, it is up to the skill of the pedagogy and therapeutical supervising person to substantially find out all the possibilities of the gymnastic and support wedge and to experience and to test the most suitable possibilities for each child.

We claim:

1. A gymnastic and support wedge for multiple and severely handicapped children of kindergarten and school age, comprising:

a wedge-like base plate member, said base plate member being rectangular and having an upper side and two longitudinal sides and having two longitudinally-extending flaps on its upper side which are each disposed along and spaced at a predetermined distance from an opposite longitudinal side of said base plate;

a pair of lateral trough wedge members mountable on said base plate member, each having a width equal to the predetermined distance of the disposition of each of said flaps from an opposite longitudinal side of said base plate;

a plurality of differently shaped individual members mountable between said trough wedge members in any desired position, wherein said individual members comprise a head wedge, two flat pillows for reducing the trough between said trough wedge members, a semi-cylindrical roll, a flat pillow having an integrated abduction wedge and a lower pillow associated therewith and two fixation belts; and means for detachably connecting said members to one another comprising a multiplicity of stick-on and padded belts which are arrangeable such that the person using the gymnastic and support wedge comes in contact with only the partially freely-exposed padded belts.

2. The gymnastic and support wedge of claim 1, wherein one of said padded belts is mounted on said upper side of said base plate member along and spaced from each of the outer longitudinally-extending edges thereof.

3. The gymnastic and support wedge of claim 1 wherein said flaps of said base plate member are provided with a padded belt at the side thereof facing the associated trough wedge member.

4. The gymnastic and support wedge of claim 1, wherein two centrally-disposed spaced-apart padded belts are provided on the upper side of said base plate member between and running parallel to said flaps.

5. The gymnastic and support wedge of claim 1, wherein the two loose padded belts are mounted on said bottom face of said base plate member adjacent to the center area of said rear face thereof.

6. The gymnastic and support wedge of claim 1, wherein said bottom face of each trough wedge member is provided with an outwardly-disposed stick-on belt.

7. The gymnastic and support wedge of claim 1, wherein said trough wedge members have side faces facing said flaps of said base plate members, each of which has mounted thereon in the lower area thereof one continuous stick-on belt.

8. The gymnastic and support wedge of claim 7, wherein a padded belt is mounted on said side faces of said trough wedge members above said stick-on belt on said side face of each trough wedge member in the area of the wider end portion of said trough wedge members.

9. The gymnastic and support wedge of claim 8, wherein said two flat pillow at each have a longitudinal side on which a stick-on belt is mounted which is positioned in a manner corresponding to said padded belt of said trough wedge member.

10. The gymnastic and support wedge of claim 4, wherein said flat pillow with said integrated abduction part has an upper side and a lower side, the latter of which is provided with two stick-on belts which are positioned in a manner corresponding to the centrally disposed padded belts of said base plate member and between which said abduction part is positioned on the upper side of said flat pillow.

11. The gymnastic and support wedge of claim 10, wherein said lower pillow has a lower side having two stick-on belts and an upper side having two padded belts which are positioned in a manner corresponding to the two centrally-disposed padded belts of said base plate member.

12. The gymnastic and support wedge of claim 4, wherein said head wedge has a lower side on which two stick-on belts are mounted which are positioned in a manner corresponding to said centrally-disposed belts of said base plate member.

13. The gymnastic and support wedge of claim 4, wherein said semi-cylindrical roll has a lower side on which two stick-on belts are mounted which are positioned in a manner which correspond to said centrally-disposed belts of base plate member.

14. The gymnastic and support wedge of claim 7, wherein said fixation belts have ends which are alternatively provided with a stick-on or a padded belt.

15. The gymnastic and support wedge of claim 14 wherein said members are differently colored.

16. The gymnastic and support wedge of claim 1, wherein said two longitudinally-extending flaps on the upper side of said wedge-like base plate member are formed of artificial leather.

* * * * *